US005209860A

United States Patent [19]

Trivett

[11] Patent Number: 5,209,860

[45] Date of Patent: May 11, 1993

[54] ACRYLATE POLYMER-FATTY TRIGLYCERIDE AQUEOUS DISPERSION PRELUBES FOR ALL METALS

[75] Inventor: Robert L. Trivett, Aurora, Ill.

[73] Assignee: Nalco Chemical Company, Naperville, Ill.

[21] Appl. No.: 739,371

[22] Filed: Aug. 2, 1991

[51] Int. Cl.[5] ..... C10L 173/02

[52] U.S. Cl. ..... 252/19; 252/34.7; 252/49.5; 252/51.5 R; 252/52 R; 252/56 R

[58] Field of Search ..... 252/19, 26, 34.7, 49.5, 252/51.5 R, 52 R, 56 R

[56] References Cited

U.S. PATENT DOCUMENTS

| | | | |
|---|---|---|---|
| 3,080,330 | 3/1963 | Rudel et al. | 260/18 |
| 4,440,654 | 4/1984 | Zimzik | 252/49.5 |
| 4,522,733 | 6/1985 | Jonnes | 252/49.5 |
| 4,846,986 | 6/1989 | Trivett | 252/49.5 |
| 4,851,043 | 7/1989 | Dotson et al. | 106/14.11 |
| 5,074,913 | 12/1991 | Trivett | 106/14.34 |
| 5,089,157 | 2/1992 | Trivett | 252/51.5 A |
| 5,091,100 | 2/1992 | Trivett | 252/51.5 R |

OTHER PUBLICATIONS

S.N. 07/670,660 Patent No. 5,089,157.

S.N. 07/632,572 Patent No. 5,074,913.

S.N. 07/569,802, Patent No. 5,091,100.

*Primary Examiner*—Margaret Medley

*Attorney, Agent, or Firm*—John G. Premo; James J. Drake; Robert A. Miller

[57] ABSTRACT

A solid film prelube comprising a polyacrylic acid-fatty acid tryglyceride composition in the form of an aqueous dispersion having the formula designed for use on all ferrous and non-ferrous metals at coating weight from - :o 500 mg/ft$^2$:

| | INGREDIENTS | % BY WEIGHT |
|---|---|---|
| A. | Polyacrylic acid salt-MW 10,000 to 200,00 | 10–20 |
| B. | 2-amino-2methyl-1-propanol as salt of A | 2–6 |
| C. | Free 2-amino-2-methyl-1-propanol | 0.05–1 |
| D. | Ammonium Benzoate | 0.05–1 |
| E. | Alkyl $C_{10}$ to $C_{20}$ betaine | 0.1–5 |
| F. | The Fatty Triglyceride | 1–5 |
| G. | Ammonium hydroxide | Sufficient to form a partial Salt of Ingredient A |
| H. | Ammonia-Zinc Oxide Complex | 0.1–2.0 |
| I. | Water | Balance |

4 Claims, No Drawings

ACRYLATE POLYMER-FATTY TRIGLYCERIDE AQUEOUS DISPERSION PRELUBES FOR ALL METALS

TECHNICAL FIELD OF THE INVENTION

The present invention is in the technical field of metalworking operations, specifically stamping and drawing and the lubricants used therefore, particularly solid film (dry film) prelubes for steel used in both the automotive, appliance and general manufacturing industries.

BACKGROUND OF THE INVENTION

Lubricants, especially solid film prelubes, are utilized in several metalworking operations. These metalworking operations can include stamping, drawing, forming, bending, rolling, cutting, grinding, punching, sawing, hobbing, reaming, spinning, extruding, trepanning, coining, swagging and the like. The present invention concerns the use of solid film (dry film) prelubes in the form of aqueous dispersions for such type of metalworking operations, utilized on all types of ferrous and non-ferrous metals used in the automotive, appliance and general manufacturing industries. In these three industries, the term, press working operation, is used to define all mechanical processes where any type of sheet metal is formed into specific shapes by the use of mechanical presses. Such operations can further be categorized as stamping and drawing. The term, stamping, is further used to describe all forming operations where parts are formed from sheet metal such that there is no change in the gauge or thickness of the sheet metal. The term, drawing, is further arbitrarily divided into shallow drawing and deep drawing. Drawing defines all forming operations where there is a change or reduction in the gauge or thickness of the sheet metal. Shallow drawing can be defined as to the forming of a cup or shape no deeper than one-half its diameter with only small reductions in metal gauge or thickness. Deep drawing can be defined as to the forming of a cup or shape deeper than half its diameter with substantial reductions in metal thickness or gauge. Formed parts for the automotive, appliance and general manufacturing industries may be produced by one or a combination of these three fundamental fabrication metalworking operations.

Forming lubricants, especially solid film prelubes facilitate these operations by reducing the friction that occurs between the sheet metal being fabricated and the tooling employed for the forming operation. By reducing the coefficient of friction for the specific forming process, power requirements, tool wear and heat generated during forming operation are all diminished. Heat significantly can affect forming operations by changing the metallurgical properties of sheet metal and tooling. It physically degrades these elements, causes their staining or oxidation and also creates physical and chemical changes in the lubricant affecting its performance. In addition, blocking or adhesion between the sheet metal and tooling is reduced or eliminated during the forming operation, transit and storage of formed parts.

In operations involving automotive, appliance and general manufacturing applications the prevention of blocking or adhesion between the sheet metal and tooling is of extreme importance. In addition, the use of specific metalworking forming lubricants such as solid film prelube aqueous dispersions significantly can reduce or eliminate the production of scrap parts (formed parts rejected due to physical damage) which may result from the failure of some forming lubricants. One major purpose of the presented invention is to provide improved lubrication and corrosion protection to all ferrous and non-ferrous metal forming operations. Forming lubricants, especially solid film prelubes, must be capable of functioning on a variety of sheet metal substrates including cold rolled steel, hot dip galvanized, electrogalvanized, hot rolled steel, galvaneal, galvalume and various aluminum alloys.

All basic steels are formed by the basic oxygen process. After the initial chemical process forming the molten steel, the molten steel is either poured to form ingots or continuously cast slabs. Ingots are then converted to slabs in a primary mill (known as a slabber or bloomer). Slabs are then processed via hot rolling:

a. slab is reheated to approximately 2500° F. in a reheat furnace,
b. reduced to any intermediate gauge or thickness via a series of roughing mills at temperatures around 1800–2000° F.,
c. then rolled to a final hot band gauge via a series of finishing mills. Finally the steel is coiled. All cold rolled, galvanized and hot rolled steel sold as pickled and oiled go on to pickling and further processing stages. Finishing mills typically operate at temperatures between 1500–1900° F.

Hot rolled steel, also known as hot rolled strip or plate steel, undergoes no further processing. These types of steel are mainly used in applications requiring structural strength and are in thicknesses of 0.060 inch and greater. A large quantity of hot rolled steel is used in deep drawing to produce compressor housings for refrigeration systems used in appliance systems. General manufacturing parts produced include gas cylinders used to store and transport liquefied petroleum gases and acetylene. Such automotive parts formed include vehicle road wheels, axle cases and a variety of chassis sidemembers. The typical mechanical properties of the three quality grades of hot rolled steel are summarized below:

a. Commercial quality (good flatness used in shallow draws): yield strength of 38,000 psi, tensile strength of 52,000 psi, 30 percent elongation for two inches and RB hardness of 55.
b. Drawing quality (deep drawn parts): yield strength of 35,000 psi, tensile strength of 50,000 psi, 36 percent elongation for two inches and RB hardness of 50.
c. Quality Special Killed age-hardened): same properties as those of drawing quality except elongation is 40%.

Some hot rolled steel will be used as simply hot rolled sheet and strip while a portion sold as hot rolled pickled and oiled exposes the hot rolled strip to an acid pickling medium (150° F.–180° F.) to remove scale, rinsed with water, then air dried and oiled. A vast majority of hot rolled steel will be used to produce cold rolled steel. The hot rolled steel will be rolled into coils and sent to cold reducing mill for further processing. At the cold mill, rolling oil emulsions are used in continuous cold reducing process to produce a variety of cold rolled steels. Cold rolled steel is used as the base template for future production of a variety of galvanized steels. Galvanized steels are becoming more prevalent in all industries because of the superior corrosion protection offered by zinc coatings applied to cold rolled steel templates. Hot dip galvanized steel is produced by passing cold rolled steel through coating applications of molten zinc. In electrogalvanizing processes, molten zinc is applied to cold rolled steel substrates by a variety of electrostatic coating applications. Other forms of galvanized steels involve zinc alloy coatings such as zinc-iron in galvaneal and zinc-aluminum in galvalume metals.

A wide variety of aluminum alloys are also used in a variety of manufacturing applications.

In several metalworking processes, sheet metal coils are cut into pieces known as blanks which are then stamped or drawn to produce the desired finished parts such as those described earlier. Forming lubricants, including solid film prelubes, are often required to provide corrosion protection against a wide range of varying environmental conditions that sheet metal coils can encounter during storage and transportation. Furthermore, when the sheet metal coil is cut into blanks, the forming lubricant must also be required to provide corrosion protection while blanks are transported to other processing facilities or while awaiting further fabrication between operations.

In the recent past, metalworking forming processes were often tedious and complicated, involving a variety of different product types. Often, sheet metals coils would arrive at a processing site, such as a stamping plant, coated with a rust preventative oil. Between the steps of blanking and the actual forming operation, the rust preventative oil would be removed by a cleaning operation (alkaline cleaner, solvent cleaner or blank wash oil . Some type of forming lubricant would then be applied to the sheet metal immediately prior to the stamping or drawing operation. Such lubricants were typically blends of petroleum hydrocarbon oils and various chemical additions. In the last decade, this tedious process of using separate rust preventative oils and drawing lubricants has been replaced in many operations by the use of a single composition known as a prelube. Whether hydrocarbon oil based or solid film, prelubes are applied at the steel mill during either temper rolling or inspection, as rust preventative oils are prior to shipping. Thus no modifications are necessary within the steel mill to physical equipment or processes to use prelubes. Such prelube compositions are thus not intentionally removed from the sheet metal until after the blanking and forming operations. Thus, the use of such prelube compositions eliminates the cumbersome process of applying and removing the combination of rust preventative oils and forming lubricants before further working with only one composition (whether oil-based or solid film). Prelubes thus must function as both a corrosion preventative and forming lubricant.

Attempts have been made to utilize the superior corrosion protection of the water soluble polyacrylic acid resins in the formulation of single component solid prelube aqueous dispersion compositions. While providing good corrosion protection to the sheet metals treated therewith the acrylic acid polymers are poor lubricants. The prior art has formulated lubricants with the acrylic acid resins in an attempt to provide both lubrication and corrosion protection. Under conditions of actual field use these products were sorely lacking in their ability to provide good lubrication during the hot working of the metal piece upon which they had been coated. If the corrosion protection afforded by water soluble polyacrylic acid resins could be incorporated into a product having superior high temperature lubricating properties an improved and desirable product would be afforded to the art.

One of the most important properties of a prelube composition besides lubrication and corrosion protection is cleanability or removability. The performance benefits offered by solid film prelube compositions, would be nullified if drastic measures were necessary to clean them from the surfaces to which they have been applied. In order to prevent interference with all future processing operations after forming, it is necessary for all traces of the prelube composition to be totally removed from the metal surface of the formed part. In the automotive, appliance and general manufacturing industries, powdered or aqueous alkaline cleaners are the normal chemical compositions utilized for removing prelube and other lubricant compositions. These alkaline cleaners are composed of various mixtures of nonionic biodegradable surfactants, amines and different types of inorganic alkalis. Such compositions are water soluble at the recommended dilutions (concentrations of one to four ounces per gallon) and are strongly alkaline in nature (pH of 10.0–12.0). They are designed to effectively remove all traces of processing lubricants and fluids from the wide variety of metal substrates described earlier including ferrous and non-ferrous metals. Formed parts are cleaned in a variety of system types utilizing spray (15–35 psi), immersion and combinations of both types. Formed parts are exposed to cleaner solutions for varying time increments, ranging from 30 seconds to 3.0 minutes for spray systems and 1.0 to 5.0 minutes for immersion systems. Such cleaner compositions effectively operate over a wide temperature range. Appliance industry parts are cleaned over a wide temperature range from 120° F. to 180° F. In the automotive industry, most formed parts are being cleaned at temperatures from 105° F. to 135° F. Parts formed in general manufacturing industries are cleaned at temperatures over a wide range from 120° F. to 190° F. Many prelube compositions, especially hydrocarbon oil based systems, contain chemical additives that cannot be easily removed with such alkaline cleaners, thereby having serious and detrimental effects on all future processing operations and narrowly limiting the use of such compositions.

An important advantage of the present invention is the improved cleanability (removability) of the solid film prelube composition from all metal substrates versus the other prelubes used on such substrate including hydrocarbon oil based and dry film lubricant compositions. This cleanability advantage also extends to all of the types of sheet metal substrates described earlier.

Sheet metal coils, including those composed of ferrous and non-ferrous metals, coated with prelube compositions can be stored for indefinite periods of time before being stamped or drawn into parts. Many chemical constituents of such prelube compositions can oxidize to varying degrees during these storage periods. Oxidations byproducts from hydrocarbon oil components can adversely affect metal surfaces causing staining, discoloration and etching or pitting of the outer molecular layers of the steel strip. Automotive, appliance and general manufacturing industries require prelube compositions that will protect all metal substrates against conditions of oxidation and will not cause contact staining during storage periods.

Prelubes must be compatible with other processing chemicals and operations following forming operations. Many parts formed in the automotive, appliance and general manufacturing industries often have severe bends or angles formed during fabrication operations. These bends and angles can create flanges, seams or other tight radii where prelube compositions can become entrapped. Even with normal exposure to alkaline cleaners, trace amounts of prelube can remain within these intricate areas out of reach. Thus, although the prelube compositions may be effectively removed from exposed part surfaces, trace amounts of prelube can be volatilized, released and contaminate subsequent processing operations. This potential situation necessitates that such prelube compositions, especially solid film prelube compositions, be compatible with cathodic electrocoat paint primers and adhesives use to bond structural components together as well as any type of post welding operations. Trace levels of contamination cannot interfere with the electrocoat process of deposition of paint primers where resulting craters could lead to potential paint finish problems and corrosion. Likewise, contamination cannot affect the wetting or bonding strength of the structural adhesives. Many formed parts are often welded into sub component parts before final assembly and cleaning so the welding process or welds themselves cannot be affected in any manner. Thus prelube compositions should be compatible with such processing compositions and operations.

A vast majority of prelubes used commercially in automotive, appliance and general manufacturing industries are liquid compositions composed of petroleum hydrocarbon oils and additives. Because of their fluid nature, such compositions tend to become unevenly distributed within coated steel coils on the metal surfaces, collecting or pooling due to capillary action or gravity. The occurrence of this condition can have a drastic effect on prelube performance as film uniformity on the sheet metal strip is critical for superior corrosion protection and successful forming. Thus all of the industries discussed earlier demand a prelube that provides the desirable film uniformity thereby insuring adequate corrosion protection and lubrication required by forming operations, especially severe drawing operations. It is an important performance benefit of the present invention to provide the proper film coverage; eg., uniformity, homogenous and consistent film morphology and structure on all ferrous and non-ferrous sheet metal substrates.

Often, prelube compositions are applied at coverage rates up to 1000–2000 mg/ft$^2$ in some industries to provide the required performance. The automotive, appliance and general manufacturing industries desire prelube compositions that can offer effective performance at lower coating weights thereby improving overall cost efficiency of the forming operation. It is a desired advantage of the present invention to provide effective performance on all ferrous and non-ferrous substrates at lower coating weights between 50 and 500 mg/ft$^2$, which substantially improves forming lubricant cost performance.

All prelube compositions must lend themselves to improving housekeeping and cleanliness conditions at the mill and at the manufacturing plant. Often, hydrocarbon oil based lubricants and some dry film prelubes can leak onto machine and work surfaces or volatilize into the atmosphere creating hazardous work environments. Compositions can often create irritation or dermatitis among employees exposed to the compositions on a daily basis. Sometimes, compositions can contaminate floor trenches around forming presses, thereby often reaching waste treatment streams. It is a prime object of the present invention for ferrous and non-ferrous metals to be nonhazardous, worker friendly and safe to use on a continual basis.

Finally, a prelube composition must be compatible with the current waste treatment processes and chemicals. Prelube compositions entering those streams must have minimal to no effect on those streams as well as being chemically capable of being waste treatable. It is another purpose of the present invention to provide prelubes which are compatible with existing waste treatment schemes by both having lower quantities (because of lower coating weights) entering the stream and being treatable by current waste treating processes.

It is another object of the present invention to provide metalworking lubricants, and more specifically, a solid film prelube in the form of an acrylate polymer-fatty triglyceride aqueous dispersion for all forms of ferrous and non-ferrous metals that provides all of the foregoing desirable characteristics, and advantages especially superior corrosion protection and lubrication as well as compatibility with all processing and forming operations.

It is a further object of the present invention to provide a method of coating and lubricating a variety of ferrous and non-ferrous metal substrates that provides all of the foregoing desired advantages. These and other objects of the invention are described below.

A specific object of the invention is to provide a prelube having both superior corrosion and lubrication properties which incorporates as the primary corrosion inhibitor water soluble acrylic acid resins and fatty triglyceride as the primary lubricant.

THE INVENTION

The invention provides a solid film prelube comprising a polyacrylic acid—fatty acid triglyceride in the form of an aqueous dispersion having the following formula:

| | INGREDIENTS | % BY WEIGHT |
|---|---|---|
| A. | Polyacrylic acid salt-Mw 10,000 to 200,000 | 10–20 |
| B. | 2-amino-2-methyl-1-propanol as salt of A | 2–6 |
| C. | Free 2-amino-2-methyl-1-propanol | 0.05–1 |
| D. | Ammonium Benzoate | 0.05–1 |
| E. | Alkyl $C_{10}$ to $C_{20}$ betaine | 0.1–5 |
| F. | The Fatty Triglyceride | 1–5 |
| G.* | Ammonium hydroxide | Sufficient to form a partial Salt of Ingredient A |
| H. | Ammonia-Zinc Oxide Complex | 0.1–2.0 |
| I. | Water | Balance |

*Other alkalies, e.g. alkali metal bases can be substituted for the ammonium hydroxide.

While the above formula represents the general formula useful in the practice of the invention a preferred formula is as follows:

| | INGREDIENTS | % BY WEIGHT |
|---|---|---|
| A. | Polyacrylic acid salt-Mw 10,000 to 100,000 | 10–15 |
| B. | 2-amino-2-methyl-1-propanol as salt of A | 3–5 |
| C. | Free 2-amino-2-methyl-1-propanol | .1–.5 |
| D. | Ammonium Benzoate | .1–1 |
| E. | Alkyl $C_{10}$ to $C_{20}$ betaine | .5–3 |
| F. | Fatty Triglyceride | 1–3 |

-continued

| INGREDIENTS | % BY WEIGHT |
|---|---|
| G. Ammonium hydroxide | Sufficient to form a partial salt of Ingredient A |
| H. Ammonia-Zinc Oxide Complex | 0.1–2.0 |
| I. Water | Balance |

The aqueous dispersion of the presented invention is considered a high temperature prelube composition in that the decomposition point of the dried aqueous dispersion coating upon evaporation of the aqueous carrier is between 650° F. and 700° F. It easily can be applied as is to a metal substrate via a roll coater system by one of two methods:

a. aqueous dispersion is warmed and applied to a warm metal substrate,
b. aqueous dispersion is applied at ambient temperature to a metal substrate at ambient temperature. Depending upon the choice of application, a series of warm ovens may be necessary to evaporate the aqueous carrier, reflow the coating following drying or both. Under normal application conditions, the water readily evaporates leaving a dry, solid film prelube coating on the metal substrate.

THE POLYACRYLIC ACID SALT CORROSION INHIBITORS

The invention takes advantage of the fact that low molecular weight polyacrylic acids, e.g. those having a molecular weight within the range of 10–200,000 are particularly effective corrosion inhibitors when applied as a thin film to a variety of metal substrates. They are usually applied in the form of their water soluble salts. As indicated they are deficient when used in high temperature lubrication applications since they tend to have little or no lubricity. The present invention utilizes their corrosion inhibiting properties and yet at the same time improves their lubricity. This is accomplished by the partial neutralization of the starting polyacrylic acid with the amine, 2-amino-2-methyl-1-propanol. This particular salt of the polyacrylic acids imparts to the finished formulas of the invention a variety of properties. It enhances the aqueous solubility of the polyacrylic acid. It improves its corrosion inhibition properties and is a source of reserve alkalinity. It seems to improve the lubricating properties of the polyacrylic acid resins since it makes them more compatible with fatty triglycerides which are the primary lubricating ingredient of the composition. Another advantage of making the partial salt of the polyacrylic acid with a 2-amino-2-methyl-1-propanol is that these salts are biocidal and tend to prevent the growth of microorganisms in the formulas under conditions of long term storage either in the form before they are applied or after applied to metal substrates.

The starting polyacrylic acid resin is primarily neutralized with ammonium hydroxide (aqueous ammonia). This particular salt of the polyacrylic acid imparts a variety of performance properties to the aqueous dispersion itself and most particularly performance properties which are extremely important during the application of the aqueous dispersion invention itself. It tremendously improves the aqueous solubility of the polyacrylic acid resin and functions as the primary source of alkalinity in the aqueous dispersion invention itself. The low vapor pressure properties of ammonia allow the aqueous dispersion invention during the coating process to be readily applied to a variety of metal substrates via a number of different application methods and allowing for the rapid evaporation of the aqueous carrier from the applied invention and subsequent curing of the dried coating.

A preferred polyacrylic acid of the type described above is sold under the trade name of Carboset XPD-1214 and has a weight average molecular weight of about 50,000.

THE FATTY TRIGLYCERIDE

The active lubricant is a fatty triglyceride blend, primarily composed of an ester containing carbon chains from 14 to 22 carbon atoms. It may also contain substituents such as partially-esterfied vegetable oils and $C_{18}$ based imidazolines. The preferred triglycerides are saturated. They may be mixed triglycerides of the types commonly found in animal fats and vegetable oils.

In more preferred embodiments, the substantially saturated ester is a diglyceride or triglyceride formed with carboxylic acids at least 90 percent of which have carbon chains containing from 14 to 22 carbons. A very preferred embodiment is a triglyceride, either stearic acid triglyceride or the substantially refined hydrogenated triglyceride derived from tallow having an acid number from 0 to 5, a saponification number of 190 to 210 and an approximate melting point of 130° F.

The triglyceride blend in the described invention also contains by weight a certain composition composed of a blend of L-aspartic acid and an oleylimidazoline. The most preferred composition is a blend of L-aspartic acid, N-(3-carboxy-1-oxo-2-propenyl)-(-N-octadecyl-,bis(2-methyl propyl)ester, Z and 1-H-imidazole-1-ethanol,2-(heptadecenyl)-4,5,-dihydro. Such composition will have an acid value of 65–75, an alkali value of 30–40 and be fluid at ambient temperatures. Such triglyceride blend can also contain partially esterified vegetable oils, derived from castor oil, rape seed oil, soybean oil, cottonseed oil, canola oil and mixtures thereof.

THE BENZOATE SALT AND THE ALKYL BETAINE

To further improve the corrosion protection afforded by the composition of the invention the ammonium benzoate and the alkyl betaine function to further enhance the corrosion protection afforded by the polyacrylate salts. One problem often occurring during the application of aqueous coatings to clean metal substrates is the formation of flash rust during the drying sequence. Coatings are often incapable of offering the necessary corrosion protection while the aqueous carrier is being evaporated from the coating. During the evaporation process, the aqueous carrier may institute the formation and appearance of pinpoint corrosion or stain on the metal surface. The ammonium benzoate when incorporated specifically into the described invention functions to prevent the formation and appearance of this pinpoint corrosion. It effectually prevents the formation of any corrosion on the metal substrate during evaporation of the aqueous carrier allowing the described invention to wet out, adhere and cure on a clean metal surface devoid of any corrosion. A problem frequently encountered in metal surfaces coated with prelubes is that they are susceptible to acidic environmental corrosion which is frequently a common phenomena in various types of metal working plants and operations of the types herein before described. The betaine when incorporated in the formula is there specifically to prevent this acidic type of corrosion from occurring. The most preferred alkyl betaine is Mona AT-1200 manufactured by Mona Industries, Inc. The most preferred alkyl betaine is Mona AT-1200, most specifically dihydroxyethyl tallow glycinate which is a clear, viscous fluid at ambient temperature with a color (GVCS-33) of 9.0, pH of 5.5 and total solids of 41.0%.

AMMONIA-ZINC OXIDE COMPLEX

The invention takes advantages of the fact that ammonia-zinc oxide complexes can be added to polyacrylic resin codispersions to increase the hardness of the applied coating. Hardness can be varied over a wide range depending upon the level of the complex added. These ammonia-zinc oxide complexes function as cross-linking agents in the coating to increase hardness, improve mar and scuff resistance and blocking and heat resistance. The most preferred ammonia-zinc oxide complex is Zinplex 15 from Ultra Additives, Inc. Zinplex 15 is a colorless liquid with a pH of 11.5 and a weight per gallon of approximately 10.1. It is a blend of ammonia, zinc oxide and water.

USE OF THE LUBRICANT

The lubricant, according to the present invention provides a solid film prelube aqueous dispersion coating particularly useful in metalworking operations and particularly advantageous for stamping and drawing operations on all types of ferrous and non-ferrous metals for applications in the automotive, appliance and general manufacturing industries. The particular coating is characterized as a solid dry film because only a solid film is left upon evaporation of the aqueous carrier.

The lubricant, according to the present invention, as described in more detail below is generally one that is liquid at ambient room temperature and applied to metal substrates at elevated temperatures in the form of an aqueous dispersion. Evaporation of the water from this dispersion form results in a uniform and homogenous, dry solid lubricant coating on the metal substrate.

As mentioned earlier, the properties of corrosion prevention and forming lubrication capabilities of the solid film prelube composition for all metal surfaces are both highly dependent to a significant degree upon the uniformity of lubricant coating film on the metal substrate. Performance properties of prelube compositions, especially solid film prelubes, are greatly enhanced and advanced by the presence of a uniform and homogenous coating on the metal substrate until such time during which the coating is removed by some form of cleaning operation. The lubricant, according to the present invention, offers this important performance advantage in that it is a solid, consistent and continuous coating which is retained on the metal substrate until such time removability is called for.

The lubricant of the present invention is particularly useful as a solid film prelube coating for applications on all types of ferrous and non-ferrous metals and other metal substrates in the automotive, appliance and general manufacturing industries. Its performance properties however, also would make it an excellent lubricant selection for prelube operations outside such applications and within such applications may also be applied to all work elements, tooling such as dies, the like and metal substrates.

The lubricant, according to the present invention, may successfully be coated onto a variety of metal substrates including all ferrous and non-ferrous metals by passing the substrate through a liquid bath at elevated temperatures, applying the lubricant by rollcoating, removing the excess by squeegy and then evaporating the water from the coating film. Such lubricant may also be applied in any manner suitable for a viscous liquid including brushing, dip-coating or electrostatic spray.

COATING THE LUBRICANT

For commercial applications, the solid film prelube aqueous dispersion composition may be applied via an electrostatic spray, by dipping the metal through a bath containing the composition or by running the metal through a rollcoater. A series of moving coating rolls will apply the composition to a moving metal strip (from coating pans containing the composition) as the strip runs between the rolls. A variety of coating variables including metal strip speed, speed of the coating rolls, size, number and composition of the rolls, composition viscosity and dilution, pressure of the rolls on the metal strip, gap sizes between the metal strip and coating rolls and temperature of the metal strip and solid film prelube aqueous dispersion composition all will determine the final coating weights applied.

The preferred method of application to ferrous and non-ferrous metals is applying the solid film prelube composition via a rollcoater to the metal strip at the exit end of a typical rolling mill at inspection station prior to coiling the strip. Composition can be diluted with water to a specific concentration and warmed to an application temperature from ambient to 180° F. Metal strip can efficiently be coated at line speeds from a minimum of 25 ft./minute to a maximum of 1000 ft./minute with 400–500 ft./minute being the optimum. Metal strip entering the rollcoater should have a peak metal temperature ranging from a minimum of ambient temperature to a maximum of 170° F. As the solid film prelube composition was applied to metal strip under these coating variables, water will instantaneously volatilize from the surface, cooling the coating and causing it to cure. The application of an ambient air temperature quench across the strip immediately after the rollcoater and prior to the coiling station may be necessary to cool the coil down to ambient temperature conditions before rewinding of the coil. These variables can be combined to effectively coat any metal substrate with the solid film prelube composition of the invention from a minimum coating weight of 40 mg/ft$^2$ to a maximum of 1000 mg/ft$^2$.

Despite the variety of coating methods, the solid dry film acrylate polymer-fatty triglyceride prelube dispersion for all ferrous and non-ferrous metals composition according to the present invention dries to a smooth and clear coating (which is hard, pliable, non-blocking, non-hygroscopic and odorless) on all types of metals with excellent surface adhesion and wetting properties providing a consistent and homogeneous film coating on the metal substrate.

The advantage and utility of the lubricant, according to the present invention, are further described in the following listed examples.

In all of the examples the formula tested was formula A set forth below:

| FORMULA A | |
|---|---|
| INGREDIENTS | % BY WEIGHT |
| A. Ammonium Hydroxide as salt of Carboset XPD-1214 | 13.580 |
| B. 2-amino-2-methyl-1-propanol as salt of Carboset XPD-1214 | 4.285 |
| C. Free 2-amino-2-methyl-1-propanol | 0.220 |
| D. Ammonium Benzoate | 0.250 |
| E. Alkyl $C_{10}$ to $C_{20}$ betaine | 0.900 |
| F. Fatty Acid Triglyceride Blend | 2.600 |
| G. Ammonia-Zinc Oxide | 0.800 |
| H. Water | Balance |

EXAMPLE 1

An acrylate polymer-fatty acid triglyceride aqueous dispersion solid film prelube especially adapted for the lubricating and protection of all forms of ferrous and non-ferrous metals utilized especially in the manufacturing of automobiles, appliances and all metallic articles and having the properties of being easily removed by the alkaline cleaners used in the processing of such articles and offering excellent corrosion protection and lubrication for the production of such items, according to the present invention, was prepared as follows:

One blending vessel equipped with sufficient mechanical means of stirring was used. The vessel was well insulated to allow for both uniform heating and cooling.

The following ingredients were added and mixed in the vessel: 56.50 parts by weight of a polyacrylic resin aqueous dispersion, commercially available under the registered trademark of Carboset XPD-1214 from B.F. Goodrich Specialty Polymers & Chemical Division and 28.35 parts by weight of deionized water. Blend the polyacrylic resin dispersion and water till mixture is uniform. 0.85 parts by weight of a 26.0% active ammonium hydroxide solution (aqueous ammonia) commercially available from several sources is slowly added into the vortex of the mixing polyacrylic resin-aqueous blend. 0.85 parts by weight of 2-amino-2-methyl-1-propanol, commercially available under the registered trademark of AMP-95 from Angus Chemical Company was then added slowly into the vortex of the mixing polyacrylic resin-aqueous blend. As AMP-95 addition nears completion, the mixing solution will turn from opaque to clear in appearance as resin is neutralized. A stock solution of 2.55 parts by weight of an ammonium benzoate (commercially available from Heico Chemicals Division of Whittaker Corporation as Hei-score XAB) at 10.0% solids in deionized water is then added to the vortex of the mixing resin solution. 0.90 parts by weight of an alkyl betaine, commercially available under the registered trademark of Mona AT-1200 from Mona Industries, Inc. is then added directly into the vortex of the resin solution. Solution viscosity will increase as the alkyl betaine is added so mixer speed may then need to be increased to compensate. 10.00 parts triglyceride blend is then added into the vortex of the mixing resin solution. As the triglyceride blend is added, the solution will decrease in viscosity and become white, opaque and homogenous in appearance. The aqueous-fatty triglyceride blend contains 26.0% solids by weight and is a blend of a refined hydrogenated tallow triglyceride commercially available from Humko Division of Witco Chemical Company trademark, NEUSTRENE 060; partially esterfied castor oil commercially available from Nalco Chemical as PR-4184 and an aspartic acid diester-oleic imidazoline blend, commercially available under the Mona Industries, Inc. trademark, MONACOR 39. After addition of the fatty triglyceride blend, 0.80 parts by weight of an ammonia-zinc oxide complex, commercially available under the registered trademark of Zinplex 15 from Ultra Additives was added slowly to vortex of the mixing dispersion. The final product is a white, opaque aqueous dispersion that can be characterized as follows:

| | |
|---|---|
| Appearance: | White opaque homogenous fluid |
| Ocular: | Mild acrylic |
| Weight/Gallon(25° C.): | 8.50 |
| pH (as is): | 8.50–9.0 |
| Refractive Index: | 1.363–1.365 |
| Brookfield Viscosity: | 500–1500 cps |
| Dried Coating: | Uniform and homogenous |

EXAMPLE 2

The composition prepared in Example 1 was coated onto various types of metal panels in laboratory as follows by two different methods. Test panels are purchased from major panel manufacturers and are usually 3"×6" or 4"×6" in size. Test panels are obtained from ACT and represent several substrates:

a. General Motors unpolished cold rolled steel
b. General Motors 16-18E hot dip galvanized
c. General Motors 16-90E electrogalvanized
d. Chrysler G60/AO1galvaneal
e. General Motors 16-3U hot rolled steel In addition, several aluminum alloys commercially available from aluminum mills such as Alcoa were also used. These include 3003 H14, 5052, 5182, 6010-T4, 6061-T6 and 2008-T4. In the laboratory, test panels are always coated at ambient conditions to achieve specific dried coating weights (mg/ft$^2$). This is accomplished by utilizing combinations of various drawdown coating bars (available from Paul Gardner Company) and specific dilutions of the described invention with deionized water.

Before coating, all test panels are cleaned with Xylene and hexane. When dry, the panel weight was recorded to 1/10,000th of a gram on a precise analytical balance (such as a Mettler).

While being coated, test panels are always handled by the preparer wearing disposable latex gloves to prevent surface metal contamination. Coated panels are allowed to dry at ambient temperatures for 24 hours. The coated panels were then reweighed again on the same scale and lubricant coating weights are then calculated and reported in milligrams per square foot.

The coated methods described above are adequate for only small laboratory applications and preparations. For commercial applications, the primary means of application is applying the lubricant in a liquid form to a moving metal strip by a series of coating rolls. A series of ovens or fans would be used to drive off the aqueous carrier and cure the coating.

Despite the variety of coating methods, the lubricant, according to the present invention; provides a transparent, smooth film (which is hard yet pliable) on all types of metal with excellent surface adhesion and wetting properties providing a homogeneous and consistent film coating on the metal from a minimum coating weight of 40 mg/ft$^2$ to a maximum of 1000 mg/ft$^2$.

EXAMPLE 3

The solid film prelube aqueous dispersion composition prepared in Example 1 was tested to determine its forming and drawing characteristics on four steel substrates using the double draw bead simulator. 2"×12" test strips were coated as described in Method 1 of Example 2. Four test substrates used were four listed in Example 2. They were cold rolled steel, hot dip galvanized, electrogalvanized and galvaneal. All four steel substrates are currently in use by major automotive manufacturers.

Solid film composition was applied to an area of 2"×5" on both sides at one end of each strip. Test strips were aged 24 hours at ambient temperature prior to testing. Three test strips were produced for each lubricant of each steel substrate type. Average coating weights were 100−10 mg/ft$^2$. Test strips were then drawn through a pair of mated dies containing a series of three fixed draw bead surfaces in an A shape configuration. Strips were placed in fixed grips at one end with a grip pressurization of 3,000 psi. Strips were pulled a total distance of five inches through the dies at the rate of 100 inches per minute, a total downward force of 11,000 pounds exerted on the strips. An individual coefficient of friction is calculated for each coated strip followed by an average coefficient of friction for each set of three test strips for each lubricant and substrate combination.

Coefficients of friction are calculated using the following equation:

$$\mu = \frac{B - A}{pi \times C}$$

$\mu$ is coefficient of friction
A is roller draw load
B is fixed draw load
C is fixed draw normal load.

A and B would represent the pulling forces, while C is the normal force. Pi is in the denominator to compensate for bead geometry.

Three commercial prelubes were also evaluated for comparative purposes, two hydrocarbon oil-based and one acrylic polymer. In comparison, average coefficients of friction are listed below:

| | Average Coefficient of Friction | | | |
|---|---|---|---|---|
| Lubricant | Cold Rolled Steel | Hot Dip Galvanized | Electrogalvanized | Galvaneal |
| Composition A | 0.0856 | 0.0964 | 0.0513 | 0.0813 |
| Acrylic Polymer | 0.1421 | 0.1248 | 0.1194 | 0.1426 |
| Hydrocarbon Lubricant 1 | 0.1202 | 0.1140 | 0.0873 | 0.0961 |
| Hydrocarbon Lubricant 2 | 0.1734 | 0.1613 | 0.1436 | 0.1780 |

The solid film prelube aqueous dispersion described in Example 1 provided better lubrication (based on lower average coefficients of friction) versus the three commercial prelubes on all four steel substrates evaluated.

EXAMPLE 4

The solid film prelube aqueous dispersion composition prepared in Example 1 above was evaluated to determine whether it would provide the necessary corrosion protection required for steel substrates during long periods of storage and transit in varying conditions of humidity and temperature. The Cleveland condensing humidity cabinet is one of an accelerated nature whereby exposure to the combined adverse conditions of temperature and humidity are increased thereby reducing the time factor for practical reasons.

Coatings were evaluated on 4"×6" test panels of four steel substrates listed in Example 3: cold rolled steel, hot dip galvanized, electrogalvanized and galvaneal. Panels were coated via Method 1 as described in Example 2. Coatings were applied to achieve a dry coating weight of 150−10 mg/ft$^2$ to one side of each test panel. Panels were then aged 24 hours at ambient temperature prior to testing.

The test chamber consisted of an atmosphere of condensing humidity at 100° F. and 100% humidity. Water vapor circulated continually in the chamber, condensing on the coated surfaces of test panels facing the internal chamber of the test cabinet. Water vapor condensed on the coated surfaces of the panels continually washing the panel surfaces. Panels were always handled while wearing disposable latex gloves to prevent surface contamination on the coatings form salts and oils commonly found on human skin. Panels were examined every 24 hours and testing concluded after 15 days exposure. Test panels were placed at fifteen degree angle of incline (from the vertical) on the chamber.

For comparison, as in Example 3, three commercial prelubes (two hydrocarbon oil-based and one acrylic polymer) were also run. Since all three commercial prelubes fell seriously short on corrosion performance versus Composition A, they are presented separately since their exposure times were much shorter. Results are summarized below:

| | Corrosion by Substrate | | | |
|---|---|---|---|---|
| | Cold Rolled Steel | Hot Dip Galvanized | Electrogalvanized | Galvaneal |
| Composition A (15 day exposure) | None | 5% scattered stain | None | None |
| Commercial Prelubes | | | | |
| Hydrocarbon Lubricant 1 (5 days exposure) | 10% rust | 100% stain | 5% stain | 5% stain |
| Hydrocarbon Lubricant 2 (2 days exposure) | 100% rust | 100% stain | 100% stain | 50% stain |
| Acrylic Polymer (6 days exposure) | 10% rust | 100% stain | 30% stain | None |

The solid film prelube aqueous dispersion composition described in Example 1 provided excellent corrosion protection as tested (under the conditions of temperature and humidity tested) on all four steel substrates versus the three commercial prelubes.

In addition, Phase I corrosion testing for automotive applications were run and confirmed by independent laboratory testing. These tests are corrosion specifications determined by both Ford Motor Company and General Motors for automotive approval. Tests and results for four steel substrates are summarized below:

A. Ford Specification M-14B90A-B(F) consists of a consecutive 72 hours exposure cycle on Cleveland condensing humidity cabinet at 100° F. and 100% relative humidity. Solid film prelube aqueous dispersion described in Example 1 was tested at coating weight of 300 mg/ft$^2$ versus the control mill oil and competitive hydrocarbon prelube which were both tested at the specified 800 to 900 mg/ft$^{w}$. Results were:

| | Degree of Corrosion | | | |
|---|---|---|---|---|
| | Cold Rolled Steel | Hot Dip Galvanized | Electro-gal-vanized | Gal-vaneal |
| Composition A | None | 2% stain | None | None |
| Control Mill Oil | 5% rust | 20% stain | 5% stain | None |
| Hydrocarbon Prelube | 75% rust | 10% stain | 5% stain | 40% stain |

The solid film prelube aqueous dispersion described in Example 1 provided better corrosion protection than control mill oil and competitive prelube on all four steel substrates and would thus meet Ford Motor Company requirements.

In addition, the Ford test procedure was repeated on a number of non-ferrous aluminum alloys used in several manufacturing industries including automotive. Solid film prelube aqueous dispersion described in Example 1 was tested at coating weight of 300 mg/ft$^2$ versus the control products (synthetic ester and emulsifiable soluble oil) which were both evaluated at 1000 mg/ft$^2$. Results were:

| | Degree of Stain | | |
|---|---|---|---|
| Alloy | Composition A | Synthetic Ester | Soluble Oil |
| 3003 H14 | None | 20% stain | 70% stain |
| 5052 | None | 10% stain | 45% stain |
| 5182 | None | 25% stain | 40% stain |
| 6010 T4 | None | 20% stain | 45% stain |
| 6061 T6 | None | 40% stain | 75% stain |
| 2008 T4 | None | 15% stain | 35% stain |

The solid film aqueous dispersion prelube described in Example 1 provided superior corrosion protection on all six aluminum alloys versus two competitive products and would thus satisfy Ford Motor Company requirements.

B. General Motor Specification 9617P consists of a ten cycle corrosion test, each cycle consisting of eight hours exposure at ambient temperature and sixteen hours exposure in the humidity cabinet at 95° F. and 100% relative humidity. Solid film aqueous dispersion prelube described in Example 1 was tested at coating weight of 300 mg/ft$^2$ versus control oil specified at 800 to 900 mg/ft$^2$. Humidity cabinet is maintained according to ASTM D-2247-87 test procedure. Ten cycles run were consecutive. Results were:

| | Cold Rolled Steel | Hot Dip Galvanized | Electro Galvanized | Galvaneal |
|---|---|---|---|---|
| Composition A | 1% rust | None | None | None |
| Control Mill Oil | 30% rust | 100% stain | 100% stain | 45% stain |

The solid film prelube aqueous dispersion described in Example 1 provided better corrosion protection than the control mill oil on all four substrates and would thus satisfy General Motors requirements.

EXAMPLE 5

Metal coils and blanks may be stored under field conditions near pickling baths and cleaner lines where atmospheric acid fumes from these baths/lines can severely stain and corrode the steel. For this reason, Example 1 lubricant was tested to determine its effectiveness in protecting four metal substrates from corrosion and staining in acid environments.

A controlled atmosphere test chamber was used. The controlled atmosphere test chamber was charged with separate solutions of deionized water and hydrochloric acid solution which produced a 25 ppm acid vapor in the test chamber. A gear motor rotated a plexiglass rotor which circulated the acid vapor in the chamber. 50 mls of acid was placed in a central beaker which was surrounded by 200 mls of deionized water in the chamber bottom. Panels are suspended vertically into the chamber through slits in the chamber lid.

Prior to coating, the panels were cleaned by washing in hexane and then air dried. 4.5" by 3.0" metal panels were used as the test substrate. Lubricant was applied at a coating weight of 200±10 mg/ft$^2$ to one side panel as described in Example 2. Panels were then air dried for 24 hours at ambient temperature. Panels were always handled while wearing latex gloves to prevent surface contamination. The test chamber was run for 30 minutes prior to panel insertion to allow the acid atmosphere to equilibrate.

The panels were placed in the chamber and run for 16 hours. For comparison, a competitive hydrocarbon prelube was evaluated at 1000 mg/ft$^2$ and an acrylic polymer prelube at 500 mg/ft$^2$. After 16 hours exposure, the panels were removed and examined visually for the percentage of surface area stained or corroded. The corrosion results are summarized below:

| | Degree of Stain | | | |
|---|---|---|---|---|
| | Cold Rolled Steel | Hot Dip Gal-vanized | Electro Gal-vanized | Gal-vaneal |
| Composition A | 1% pinpoint rust | None | None | 1% pinpoint stain |
| Hydrocarbon Prelube | 80% stain | 25% stain | None | 20% stain |
| Acrylic Polymer | 100% stain | 30% stain | 40% stain | 20% stain |

The solid film prelube aqueous dispersion described in Example 1 provided excellent corrosion protection against acid fumes under the conditions tested versus the two commercial products.

EXAMPLE 6

Cleanability, defined as the total removal of a solid film prelube coating, is extremely important. After metal parts are formed, the parts may be transferred to a variety of future processing operations including welding, bonding via use of structural adhesives or the deposition of a wide range of coatings including phosphate coatings and electrically applied primers and top coats.

For this reason, the solid film prelube composition described in Example 1 was tested for its removability via standard aqueous alkaline cleaners (at their recommended operating parameters) that are used in the U.S. automotive industry. Cleanability tests were run in a power spray wash unit, a self-enclosed system where alkaline cleaner solution is recirculated in a closed loop system. Cleaner solution is continuously heated in line and is applied to test panels hanging within the test chamber over a range of application pressures from five to thirty five psi. Solid film prelube composition described in Example 1 was applied to test panels (4"×6") of four substrates described in Example 2 via laboratory coating described in Example 2. The four test substrates were cold rolled steel, hot dip galvanized, electrogalvanized and galvaneal. Coating was applied to one side of the test panels to achieve a dry coating weight of 150−10 mg/ft$^2$.

Two cleaning schemes were used, using powdered alkaline cleaners produced by Parker-Amchem. Two regiments are described below:

1. Parco 1500C run at a concentration of two ounces per gallon at temperature of 105−1° F. Panels were exposed for two minutes to a spray solution applied at 20 psi.
2. Parco 2331 run at a concentration of one ounce per gallon at temperature of 120, 130 and 140° F. Panels were exposed for one minute to a spray solution applied at 20 psi. Temperature variance for all three application temperatures was plus or minus one degree.

Following both cleaning schemes, panels were rinsed for thirty second in a deionized water rinse spray applied at 20 psi. Panels were then fully immersed in a saturated aqueous copper sulfate solution (slightly acidic) which deposits a uniform copper coating on all cleaned areas. This presents an excellent visual record of the degree of the cleanability. Results are presented below:

| | DEGREE OF CLEANABILITY | | | |
|---|---|---|---|---|
| | Cold Rolled Steel | Hot Dip Galvanized | Electro-galvanized | Galvaneal |
| 1. Parco 1500C | | | | |
| at 105° F. | 100% clean | 100% clean | 100% clean | 100% clean |
| 2. Parco 2331 | | | | |
| at 120° F. | 100% clean | 100% clean | 100% clean | 100% clean |
| at 130° F. | 100% clean | 100% clean | 100% clean | 100% clean |
| at 140° F. | 100% clean | 100% clean | 100% clean | 100% clean |

The solid film prelube composition described in Example 1 was easily removed on all test substrates with both of the automotive alkaline cleaners at their recommended operating conditions.

EXAMPLE 7

In addition to cleanability evaluations with standard aqueous alkaline cleaners in an uncontaminated state, cleanability results are also presented for contaminated alkaline cleaner streams. The solid film prelube aqueous dispersion composition described in Example 1 was also tested for removability in standard aqueous alkaline cleaner contaminated with varying levels of the composition itself. This information is extremely important since alkaline cleaner systems often function with various levels of contamination. Contaminants are often removed on a periodic basis by filtering or skimming but alkaline cleaner systems can only tolerate certain levels of contamination before there are drastic effects on effectiveness of the cleaner. At this point, the alkaline cleaner system will usually be dumped (discharged to waste treatment), rinsed and recharged with new alkaline cleaner solution.

Cleanability tests were run in a power spary wash unit with Parco 1500C at concentration of two ounces per gallon at temperature of 105° F. Formula A was applied to test panels at 125–150 mg/ft$^2$ on the following substrates (described in Example 2).

A. Cold roll steel.
B. Hot Dip Galvanized
C. Electrogalvanized.

Panels were cleaned for two minutes at 105° F. with spray pressure of 20 psi. Cleaner bath contained one gallon of alkaline cleaner solution and was contaminated in successive steps at levels of 0.5%, by weight, of Formula A (20 grams). After each successive contamination, a set of three panels were cleaned (one of each substrate type), then rinsed for 15 seconds in deionized water at 100° F. Panels were then immersed in saturated copper sulfate solution for a visual record of coating removal. With each successive contamination stage, particular attention was paid to panels for the effects of load buildup in the cleaner stream, either ineffective coating removal or the redeposition of coating onto metal surface. Results are summarized below:

| FORMULA A LEVEL IN STREAM | DEGREE OF CLEANABILITY BY SUBSTRATE | | |
|---|---|---|---|
| | CRS | HDG | EG |
| None | 100% Clean | 100% Clean | 100% Clean |
| 0.5% | 100% Clean | 100% Clean | 100% Clean |
| 1.0% | 100% Clean | 100% Clean | 100% Clean |
| 1.5% | 100% Clean | 100% Clean | 100% Clean |
| 2.0% | 100% Clean | 100% Clean | 100% Clean |
| 2.5% | 95% Clean | 100% Clean | 100% Clean |
| 3.0% | 95% Clean | 95% Clean | 95% Clean |
| 3.5% | All 95% clean, but varying areas of unremoved coating. | | |

Results indicate that in a spray wash system, slightly higher levels of Composition A (2.0% by weight) can be tolerated before there is a noticeable effect in cleanability on various substrates. Cleaning effectiveness was reduced on cold roll steel substrates at levels of 2.5% and on galvanized substrates at levels of 3.0% and above. These levels are on average 0.5% by weight higher than those observed in static cleanability tests. In addition, there will often be various combinations of contaminants in alkaline cleaner streams. These contaminants can often have more serious effects on cleanability at lower levels than would be experienced with the individual contaminants alone at higher levels. Cleanability tests were run in a power spray with Parco 1500C at concentration of two ounces per gallon at temperature of 105° F. Formula A was applied to test panels at dry coating weight of 125–150 mg/ft$^2$ on the following substrates (described in Example 2):

A. Cold roll steel.
B. Hot dip galvanized.
C. Electrogalvanized.

Panels were cleaned for two minutes at 105° F. with spray pressure of 20 psi. Cleaner bath contained one gallon of alkaline cleaner and was contaminated in successive steps of 0.25–0.50% by weight (10.0–20.0 grams) of Formula A and a mill oil. After each successive contamination, a set of three panels were cleaned (one of each substrate type), then rinsed for 15 seconds in deionized water at 110° F. Panels were then immersed in a saturated copper sulfate solution for a visual record of coating removal. With each successive contamination stage, particular attention was paid to panels for the effects of load buildup in the cleaner stream (ineffective coating removal or redeposition of coating onto metal surface). Results are summarized below:

| CONTAMINANT LEVEL | | DEGREE OF CLEANABILITY BY SUBSTRATE | | |
|---|---|---|---|---|
| FORMULA A | MILL OIL | CRS | HDG | EG |
| None | None | 100% Clean | 100% Clean | 100% Clean |
| 0.25% | 0.25% | 100% Clean | 100% Clean | 100% Clean |
| 0.75% | 0.75% | 100% Clean | 100% Clean | 100% Clean |
| 1.00% | 1.00% | 100% Clean | 100% Clean | 100% Clean |
| 1.25% | 1.25% | 95% Clean | 100% Clean | 100% Clean |
| 1.50% | 1.50% | 95% Clean | 95% Clean | 95% Clean |

Results indicate, at least by spray cleanability tests, combined contamination levels of Formula A and the mill oil at levels of 2.5% and above will effect the cleaning effectiveness of Parco 1500C cleaner upon Formula A at 105-110° F.

Furthermore, cleanability testing has also been done in actual cleaning lines in automotive forming and assembly plants across the country. 4"×12" panels (substrates described in Example 3) were run through the cleaner line at major automotive plant in northern Great Lakes area. The panels were successfully cleaned in their eleven stage cleaner line which utilized Parco 2331 alkaline cleaner at 120° F. as the primary alkaline cleaner, followed by phosphate operation. The phosphate coatings, in comparison to the control panels (clean and bare panels of all substrates), were uniform and homogenous in appearance and morphology. There was no difference between phosphate coatings on control versus treated panels (coated with Composition A at 75 mg/ft$_2$ via laboratory method in Example 2.

Four by three inch samples were removed from each of the six panel substrates and phosphate coating weights determined by weigh-strip-weigh. A concentrated ammonium hydroxide/ammonium dichromate aqueous solution at 120° F. was used to strip the phosphate coating from both sides of the panel samples. Panels were exposed for ten minutes followed by one minute rinse in tap water. Phosphate coating weights (average value for both sides) are listed below in milligrams per square foot.

| | DEGREE OF CORROSION | | |
|---|---|---|---|
| | Cold Rolled Steel | Hot Dip Galvanized | Electro-galvanized |
| Composition A | 214.8 | 300.7 | 278.2 |
| Control | 230.4 | 306.1 | 225.0 |

Phosphate coating weights were very uniform. Scanning electron microscope photos of both Composition A and control panels revealed all phosphate coatings to be extremely homogenous with uniform crystal sizes.

EXAMPLE 8

Besides being compatible and removable with automotive processing cleaning systems, prelubes must also be compatible with structural body adhesives used to bond automotive structural body components together. Solid film prelube aqueous dispersion composition described in Example 1 was evaluated in compatibility tests with structural body adhesives versus General Motors Test Procedure 3623M. Control combination of a commercial mill oil covered with a commercial drawing compound are tested for comparative purposes. Strip of 1"×4" two side electrogalvanized steel were cleaned with toluene and air dried. Composition A described in Example 1 was applied by laboratory method described in Example 2, to both sides of one end (one by one inch area) of several test strips at coating weight of 100 mg/ft$^2$. For control strips, strips are prepared by dipping the strips in the mill oil, draining overnight and then applying drawing compound over the mill oil. PPG-Hughes HC5099 structural body adhesive was used to prepare test setups (two strips joined end to end, oriented in same direction and overlapped one inch). Strips are clamped and baked in forced air oven for 60 minutes prior to testing. Strip sets were then pulled apart in an Instron Shear Tester to determine the adhesive failure point of the bonded strips (force required to pull the strips apart breaking the adhesive bond). The strips were pulled apart at a uniform rate one-half inch per minute, starting at a minimum distance of four inches between the jaws. The failure point of the body adhesive must be a uniform failure, breaking point occurring at ends of the strips between the adhesive. Results are summarized below for each test:

| TEST | AVERAGE BOND STRESS FAILURE POINT (psi) | |
|---|---|---|
| | Composition A | Control |
| 1. Shear Stress Test: 168 hours at ambient temperature | 2506 (pass) | 2509 (pass) |
| 2. Shear Stress Test: 168 hours immersion in water at 130° F. | 2166 (pass) | 2068 (pass) |
| 3. 20 Cycle Scab Corrosion Shear stress test | 1954 (pass) | 1852 (pass) |
| 4. Six Week Stress Shear | 2532 (pass) | 2413 (pass) |
| 5. 30 Cycle Scab Corrosion Shear stress test | 1968 (pass) | 2023 (pass) |

The solid film prelube aqueous dispersion composition described in Example 1 offered equivalent bonding strength to the control combination and passed all five phases of test sequence, having no negative effects on the bonding strength of the automotive adhesive.

EXAMPLE 9

Once metallic parts are formed, trace amounts of a prelube coating can enter the plant waste treatment process either concentrated (removed via filtering, skimming or centrifuging from the alkaline cleaner stream) or diluted in the entire alkaline cleaner stream when portions of or the entire stream is dumped. The prelube contaminant cannot interfere in any way with the overall treatment process nor any of the individual treatment chemicals used in the process. The solid film prelube aqueous dispersion composition described in Example 1 was evaluated in a standard A-IV laboratory emulsion test for waste treatability. Emulsions were inoculated with dosages of composition described in Example 1 (0.5% or 5000 ppm and 1.0% or 10,000 ppm). Mixtures were then treated with 350 ppm of Nalco N-7722 cationic polymer and 0.35 ml of alum solution. Final treatment process consisted of treatment with Nalco N-7763 anionic polymer and skimming of the solids. COD values were then run on the clear, bottom water layers that remained. COD values are listed for:

a. alkaline cleaner streams by themselves (Parco 1500C at two ounces per gallon and Parco 2331 at one ounce per gallon).

b. alkaline streams contaminated with a commercial mill oil at levels of one and three percent by weight.

c. alkaline streams contaminated with solid film prelube aqueous dispersion composition described in Example 1 at levels of one and three percent by weight. COD values of the effluent water layers are used as the comparative values. The alkaline cleaners used in the test sequence are the same ones enlisted in cleanability testing presented in Example 6.

| SAMPLE | EFFLUENT COD VALUE (ppm) |
|---|---|
| A. Control Emulsion | 1100 |
| B. Parco 1500C cleaner | |
| 5,000 ppm | 1100 |
| 10,000 ppm | 1200 |
| C. Parco 2331 cleaner | |
| 5,000 ppm | 1100 |
| 10,000 ppm | 1100 |
| D. Parco 1500C cleaner (1% mill oil) | |
| 5,000 ppm | 1100 |
| 10,000 ppm | 1200 |
| E. Parco 1500C cleaner (3% mill oil) | |
| 5,000 ppm | 1000 |
| 10,000 ppm | 1100 |
| F. Parco 2331 cleaner (1% mill oil) | |
| 5,000 ppm | 1100 |
| 10,000 ppm | 1100 |
| G. Parco 2331 cleaner (3% mill oil) | |
| 5,000 ppm | 1100 |
| 10,000 ppm | 1100 |
| H. Parco 2331 cleaner (1% Composition A) | |
| 5,000 ppm | 1100 |
| 10,000 ppm | 1200 |
| I. Parco 2331 cleaner (3% Composition A) | |
| 5,000 ppm | 1100 |
| 10,000 ppm | 1000 |
| Tested at 10,000 ppm only | |
| J. Parco 1500C cleaner (1% Composition A) | 1200 |
| K. Parco 1500C cleaner (3% Composition A) | 1200 |

As can be seen, the results clearly indicate that the solid film prelube aqueous dispersion composition described in Example 1 was easily waste treatable and had no negative effects on the treatment product dosage levels or effluent COD values. There was no negative impact on the treatability of the alkaline cleaner streams containing it. Furthermore, the COD values for Composition A were equivalent to those of the commercial mill oil contaminant that would be normally be encountered in alkaline cleaner stream. The lubricant composition described in Example 1 will have no effects on standard waste treatment processes and will be easy to waste treat itself.

EXAMPLE 10

Trace amounts of prelubricants cannot interfere with the welding of structural body components, especially in the automotive industry where spot welds are used to attach body panels to each other such as an outer door panel to an inner door panel. The prelubricant film cannot affect the weld current itself nor the quality or size of the weld itself. In addition, no noxious or hazardous fumes can result from the decomposition of the coating upon vaporization from welding heat. The lubricant described in Example 1 was applied via the laboratory method described in Example 2 to cold rolled steel test panels at coating weight of 100 mg/ft$^2$. Spot weld tests were run according to automotive specifications Ford 13-4 and General Motors MDS-247. Bare panels were used as a control. Tests are based on the weld current necessary to achieve a minimum weld nugget size. Results for both test are summarized below:

A. Ford Range Test 13-4

| | Minimum Current | Maximum Current | Current Range |
|---|---|---|---|
| Bare Control | 8810 amps | 10620 amps | 1810 amps |
| Composition A | 9207 amps | 10723 amps | 1516 amps |
| Required | N/A | N/A | 1500 amps |

Range and intensities for both bare control and described invention were very similar and easily satisfied Ford range requirement of 1500 amps minimum.

B. G. M. Range Test MDS-247

| | Minimum Current | Maximum Current | Current Range |
|---|---|---|---|
| Bare Control | 7780 amps | 10450 amps | 2670 amps |
| Composition A | 7930 amps | 9890 amps | 1960 amps |
| Required | N/A | N/A | 1800 amps |

The described invention surpassed the minimum GM range requirement of 1800 amps. Thus the described invention in Example 1 would be compatible with and have no negative effects upon the current welding processes being used in automotive industry.

Chemical analysis of gaseous by-products from decomposition of the solid film prelubricant described in Example 1 were determined to be water and carbon dioxide. Both are the simple end products of normal long chain hydrocarbon decomposition. Both of these by-products are non-hazardous and would pose no health threat.

EXAMPLE 11

During the processing of metal coils upon entering a forming plant such coils will often be washed with composition known as blank wash oils. They are usually blends of low viscosity naphthenic hydrocarbon oils (50–100 SUS at 100° F.) and specific chemical additives including surfactants and corrosion inhibitors. The primary purpose of blank washing coils is to remove dirt and debris that have accumulated on the metal surface during final inspection stages at the mill and during transit and storage. Metal coils will be blank washed just prior to the forming operation to provide a clean metal surface that will not inhibit or interfere with the forming operation in any manner. Dirt, debris and metallic fines entrapped on the metal surface can cause severe damage to expensive and exotic dies used in forming presses. Often the blank washes are applied directly over the coated metal as it arrives at the forming plant. Such coatings are usually of a corrosion preventative nature and include mill oils or prelubes. Thus, such compositions must be compatible with the blank wash composition both chemically and physically. Solid film prelube compositions including the solid film aqueous dispersion prelube described in Example 1 provide cleaner surfaces on metal coils because the hard, solid nature of the coating does not attract and entrap dirt, fines and debris as a hydrocarbon oil film would. Some facilities however want to continue blank washing even with solid film prelubes because they feel a pristine and clean surface is critical for success of the forming operation. Thus, in addition solid film prelubes must be chemically compatible with blank wash compounds applied over the top of oneselves and furthermore maintain their film characteristics (cover, adhesion and hardness) since their film integrity is crucial for successful forming in the mechanical presses. Blank wash compounds are not formulated with lubrication as a performance feature. In order to evaluate compatibility, test strips were coated with 150 mg/ft$^2$ of Composition A by laboratory method described in Example 2. The three test substrates were cold rolled steel, hot dip galvanized and electrogalvanized steels. The test strips were two by six inches in dimension and immersed for 30 days into 150 gram samples of two commercial blank washes. Because the strips were only partially immersed into oil sample, only 35 milligrams of Composition A was exposed to the 150 gram samples of blank washes. After 30 day exposure at 75° F., the strips of all three substrates were evaluated. Test strips were weighed before coating and after exposure were rinsed with hexane, air-dried and weighed again. In addition Fourier Transfer Infrared Spectrometer analytical traces were run on the blank wash oil samples before and after to detect the presence of any polyacrylic resin that may have leached from the coating of Composition A into the oils. Results are summarized below:

| | Blank Wash Compatibility | | | |
|---|---|---|---|---|
| | Compound A | | Compound B | |
| Substrate | Weight Loss | FTIR | Weight Loss | FTIR |
| Cold Rolled Steel | None | No trace | None | No trace |
| Hot Dip Galvanized | None | No trace | None | No trace |
| Electro- | None | No trace | None | No trace |

-continued

| | Blank Wash Compatibility | | | |
|---|---|---|---|---|
| | Compound A | | Compound B | |
| Substrate | Weight Loss | FTIR | Weight Loss | FTIR |
| galvanized | | | | |

The results indicate that Composition A offered outstanding long term compatibility with both blank wash compounds. The coating was totally unaffected by either blank wash over the 30 day exposure period.

Having thus described my invention it is claimed as follows.

1. A solid film prelube comprising a polyacrylic acid—fatty acid triglyceride composition in the form of an aqueous dispersion having the formula:

| INGREDIENTS | % BY WEIGHT |
|---|---|
| A. Polyacrylic acid salt-MW 10,000 to 200,00 comprising a mixture of 2-amino-2-methyl-1-propanol and ammonium hydroxide | 10–20 |
| B. 2-amino-2-methyl-1-propanol as salt of A | 2–6 |
| C. Free 2-amino-2-methyl-1-propanol | 0.05–1 |
| D. Ammonium Benzoate | 0.05–1 |
| E. Alkyl $C_{10}$ to $C_{20}$ betaine | 0.1–5 |
| F. $C_{14}$–$C_{22}$ Fatty Triglyceride | 1–5 |
| G. Ammonium hydroxide | Sufficient to form a partial Salt of Ingredient A |
| H. Ammonia-Zinc Oxide Complex | 0.1–2.0 |
| I. Water | Balance |

2. The solid film lubricant of claim 1 adapted for lubricating and protecting sheet metal used in the manufacture of automobiles and appliances.

3. The solid film lubricant of claim 1 wherein it is applied to a sheet metal in coating weight ranges from 50 to 500 mg/ft$^2$.

4. The solid prelube of claim 1 where:

| INGREDIENTS | % BY WEIGHT |
|---|---|
| A. Polyacrylic acid salt-MW 10,000 to 100,000 | 10–15 |
| B. 2-amino-2methyl-1-propanol as salt of A | 3–5 |
| C. Free 2-amino-2methyl-1-propanol | .1–.5 |
| D. Ammonium Benzoate | .1–1 |
| E. Alkyl $C_{10}$ to $C_{20}$ betaine | .5–3 |
| F. Fatty Triglyceride | 1–3 |
| G. Ammonium hydroxide | Sufficient to form a partial Salt of Ingredient A |
| H. Ammonia-Zinc Oxide Complex | 0.1–2.0 |
| I. Water | Balance |

* * * * *